United States Patent [19]

Ibsen

[11] 4,127,016

[45] Nov. 28, 1978

[54] SAFETY LOCK

[76] Inventor: Knud Ibsen, 451 W. Mall, Apt. 1518, Etobicoke, Ontario, Canada

[21] Appl. No.: 818,226

[22] Filed: Jul. 22, 1977

Related U.S. Application Data

[63] Continuation-in-part of Ser. No. 738,464, Nov. 3, 1976, abandoned.

[51] Int. Cl.[2] ..... E05B 65/10; E05C 3/10

[52] U.S. Cl. ..... 70/92; 70/139; 292/196; 292/200

[58] Field of Search ..... 70/92, 135, 136, 137, 70/138, 139; 292/7, 139, 143, 165, 167, 173, 194, 195, 196, 197, 200, 92, 336.3

[56] References Cited

U.S. PATENT DOCUMENTS

| | | | |
|---|---|---|---|
| 2,053,806 | 9/1936 | Van Note | 292/173 |
| 2,650,121 | 8/1953 | Schlage | 292/167 |
| 2,736,185 | 2/1956 | Collar | 70/137 X |
| 2,854,839 | 10/1958 | Eads | 292/200 X |
| 3,009,724 | 11/1961 | Hall | 292/226 |
| 3,103,804 | 9/1963 | Wood et al. | 292/196 X |
| 3,899,906 | 8/1975 | Bradstock | 292/200 X |

FOREIGN PATENT DOCUMENTS

| | | | |
|---|---|---|---|
| 2,152,199 | 4/1973 | Fed. Rep. of Germany | 70/137 |
| 63,890 | 3/1949 | Netherlands | 292/167 |
| 6,701,624 | 8/1967 | Netherlands | 70/135 |
| 96,630 | 8/1939 | Sweden | 292/197 |
| 955,429 | 4/1964 | United Kingdom | 70/135 |
| 985,403 | 3/1965 | United Kingdom | 292/336.3 |

*Primary Examiner*—Thomas J. Holko

[57] ABSTRACT

A safety lock comprises a lock housing, a pivotal bolt, bolt control means located in the housing to rotate the bolt from a locking to an unlocking position, key actuated means to operate the bolt control means and handle means adapted to operate the bolt control means in a manner such that the pivotal bolt rotates approximately 90° from a locking position to an unlocking position by turning the handle means which is restricted to a turning movement of less than 180°. The pivotal bolt extends outwardly from the housing when it is in a locking position. The key actuated means operates independently of the handle means and preferably rotates through an angle of at least 360°.

7 Claims, 11 Drawing Figures

SAFETY LOCK

This is a continuation-in-part application of U.S. patent application Ser. No. 738,464 filed Nov. 3, 1976, and now abandoned.

FIELD OF THE INVENTION

This invention relates to a safety lock provided with a handle restricted to rotate through less than 180° and a pivotal bolt which is pivoted from a locking position to an unlocking position by turning the handle.

BACKGROUND OF THE INVENTION

Conventional safety locks having pivotal bolts are provided with a thumb turn on one side of a lock housing and a key turn on the other side of the lock housing. When the lock is installed in a door, the thumb turn is located on the inner surface of the door and the key turn is located on the outer surface of the door. Both the thumb turn and the key turn are capable of moving through an angle of at least 360° before the bolt rotates from a locking to an unlocking position.

In order to open a locked door from the inside of a room, one first determines the direction in which the thumb turn must be rotated and then applies a force on the thumb turn knob in that direction. However, in a pressure situation on might not realize that the thumb turn will only unlock the bolt when turned in the proper direction and panic after rotating the thumb turn in the wrong direction. Also a person under stress might not rotate the thumb turn through an angle of 360° and panic because he felt that the lock was not functioning properly. In cases where the lock does not function properly the small thumb turn does not provide enough leverage for the manual force required to rotate a jammed bolt.

It is therefore an object of this invention to provide a safety lock having a pivotal bolt which can be rotated by both key actuated means and handle means.

It is another object of this invention to provide a safety lock having a pivotal bolt which is rotated from a locking position to an unlocking position by turning a handle means which is restricted to a turning movement of less than 180°.

It is a further object of the invention to provide a safety lock in which the direction of the force required on a handle means to rotate a pivotal bolt from locking position to an unlocking position is readily apparent.

It is yet another object of the present invention to provide a safety lock with a handle means having enough leverage to rotate a pivotal bolt, which has jammed, from a locking to an unlocking position.

BRIEF SUMMARY OF THE INVENTION

The safety lock according to this invention is primarily for use in a door having a narrow door stile. However, it can be used in any type of hinged or sliding door. The lock includes a lock housing, a pivotal bolt, a bolt control means located in the housing to rotate the bolt from a locking position to an unlocking position, rotatable key actuated means and rotatable handle means to operate the bolt control means. The lock also includes trapping means to restrict the rotation of the handle means to an angle of less than 180°. The key actuated means and the handle means are indepedent of one another and the key actuated means is rotatable through an angle of at least 180° to permit insertion and withdrawal of the key in both the locking and unlocking position.

When the lock is installed the key actuated means is located on the outer surface of a door and the handle means is located on the inner surface of the door so that it is accessible from the inside of a room. A person situated in the room can turn the handle means in one direction only through an angle of less than 180° to rotate the bolt from a locking position to an unlocking position. In order to rotate the bolt back to the locking position the handle means is turned in the opposite direction through the same angle.

When the bolt is in a locking position it extends outwardly from the housing. The bolt pivots through an angle of approximately 90° such that it is substantially parallel to the housing when in an unlocking position.

DESCRIPTION OF THE DRAWINGS

The aforementioned and other objects, advantages and features of the invention will become apparent in the following detailed description of the preferred embodiments according to this invention as shown in the drawings wherein.

DETAILED DESCRIPTION OF THE PREFERRED EMBODIMENTS

Figure 1:
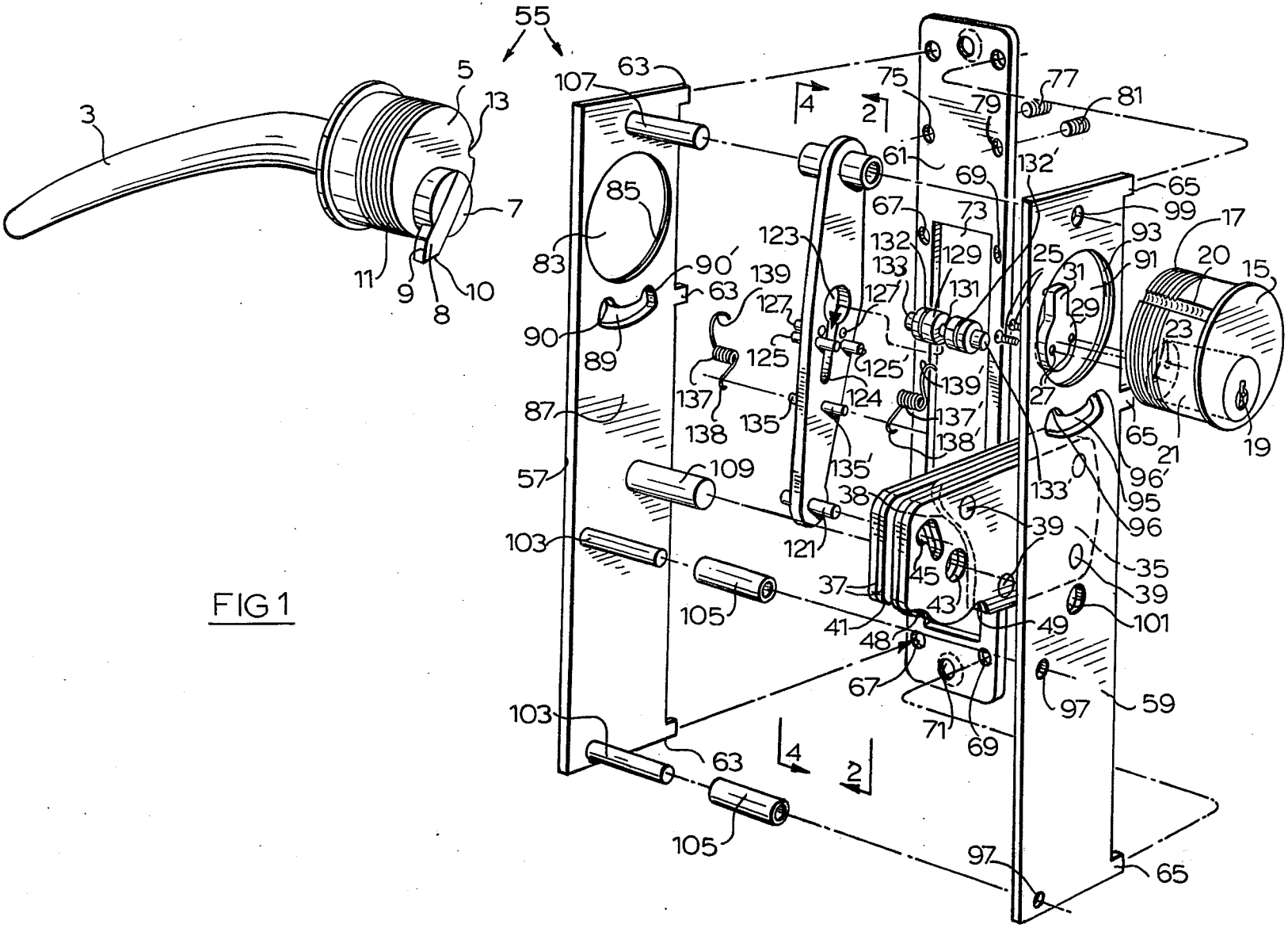
FIG. 1 is an expoloded view of a safety lock according to an embodiment of this invention.

Referring to FIG. 1, a safety lock generally indicated at 1 for use in a hinged door, includes handle 3, key turn 15, pivotal bolt 35, lock housing generally indicated at 55 and bolt control means generally indicated at 115.

Handle 3 is mounted to lock cylinder 5 which is part of the housing. The handle includes means to operate the bolt control means in the form of operating means 7 provided with operating arm 8 having camming surfaces 9, 10. Handle 3 and operating means 7 are rotatably secured in lock cylinder 5. Lock cylinder 5 is provided with threads 11 and slot 13.

Key turn 15 includes lock cylinder 17 provided with threads 18. Lock cylinder 17 which houses rotatable cylinder 21 is also provided with key aperture 19 and slot 20. Mounting means 29 provided with extension 31 is secured to rotatable cylinder 21 by screws 25 which are fitted through apertures 27 of the mounting means and threadably engaged in apertures 23 of the rotatable cylinder.

Lock housing 55 includes first side plate 57, second side plate 59 and face plate 61. The side plates are secured to the face plate by means of tabs 63, 65 which are secured in apertures 67, 69 respectively. Face plate 61 is provided with holes 71 to accommodate the screws or bolts (not shown) required for mounting the lock in a door stile. The face plate includes bolt opening 73 through which bolt 35 extends when in a locking position and threaded apertures 75, 79 which threadably engage threaded members 77 and 81 respectively.

First side plate 57 includes slot 89 having locking corners 90, 90' and is provided with aperture 83 having threads 85 which threadably engage threads 11 of lock cylinder 5. When lock cylinder 5 is engaged in aperture 83 the end of the lock cylinder extends beyond inner face 87 of the first side plate 57 and is secured against rotation by threaded member 77 which is threaded through threaded aperture 75 until it is secured in slot 13 which is aligned with the threaded aperture.

Second side plate 59 has a similar construction to first side plate 57. The second side plate includes aperture 91 having threads 93, slot 95, securing aperture 97 and shaft receiving apertures 99 and 101. Slot 95 is provided with locking corners 96, 96'. First side plate 57 includes identical securing apertures and shaft receiving apertures to those found on second side plate 59 although they are not shown in the drawings.

Lock cylinder 15 is secured in aperture 91 of the second side plate in the same manner as lock cylinder 5 is secured in aperture 83 of first side plate 57.

Housing 55 also includes securing members 103, collar members 105, upper shaft 107 and lower shaft 109. When the housing is assembled securing members 103 are force fitted and secured in securing apertures 97 with collar members 105 fitted over the securing members. The collar members have a diameter greater than that of securing apertures 97 to effectively maintain the distance between first side plate 57 and second side plate 59. Upper shaft 107 is secured in shaft receiving aperture 99 and lower shaft 109 is secured in shaft receiving aperture 101.

Pivotal bolt 35 is constructed from four similarly shaped plates 37 and recessed plate 38 centrally located in the bolt. Gap 41 is provided at one end of the recessed plate between the similarly shaped plates. The bolt also includes circular aperture 43 and irregular aperture 45. Undulating surface 47 provided with indentations 48, 49 is located at the lower inner end of pivotal bolt 35. The plates of the bolt are secured by means of lugs 39 to provide a single unit. As can be appreciated the safety lock could be adapted for use in a sliding door by providing an upwardly extending open-ended slot in the pivotal bolt.

The bolt control means includes lever 117 provided at its upper end with shaft collar 119 and at its lower end with cylindrical extension 121 which extends outwardly from both sides of the lever. Centrally positioned in the lever is a key shaped aperture 123 having a lower narrow end 124. Pegs 125, 125' which extend through lever 117 are positioned on both sides of the narrow lower end 124 of key shaped aperture 123. Positioned above pegs 125 are two trapping pins 127, 127' which outwardly extend from the side of lever 117 which faces first side plate 57.

The bolt control means also includes roll pin 129 provided with central annular recess 131 and cylindrical end portions 133, 133'. Also included in the bolt control means are springs 137, 137' provided with hooked ends 138, 139, 138' and 139'.

When the bolt control means is assembled within the housing, shaft collar 119 is fitted over upper shaft 107. Roll pin 129 is arranged such that central recess 131 is located in the lower narrow end of key shaped aperture 123. Cylindrical end portions 133, 133' of the roll pin are located in slots 89 and 95 of the first and second side plates. Spring 137 is arranged in the bolt control means with upper end 139 positioned in slot 132 of the roll pin and lower end 138 hooked over securing means 135 provided on the lever. Spring 137' is secured in the same manner on the opposite side of the lever. The lower end of lever 117 is positioned in gap 41 of pivotal bolt 35 with cylindrical extension 121 secured in irregular aperture 45. Lower shaft 109 is journalled in aperture 43 of the pivotal bolt.

Figure 2:
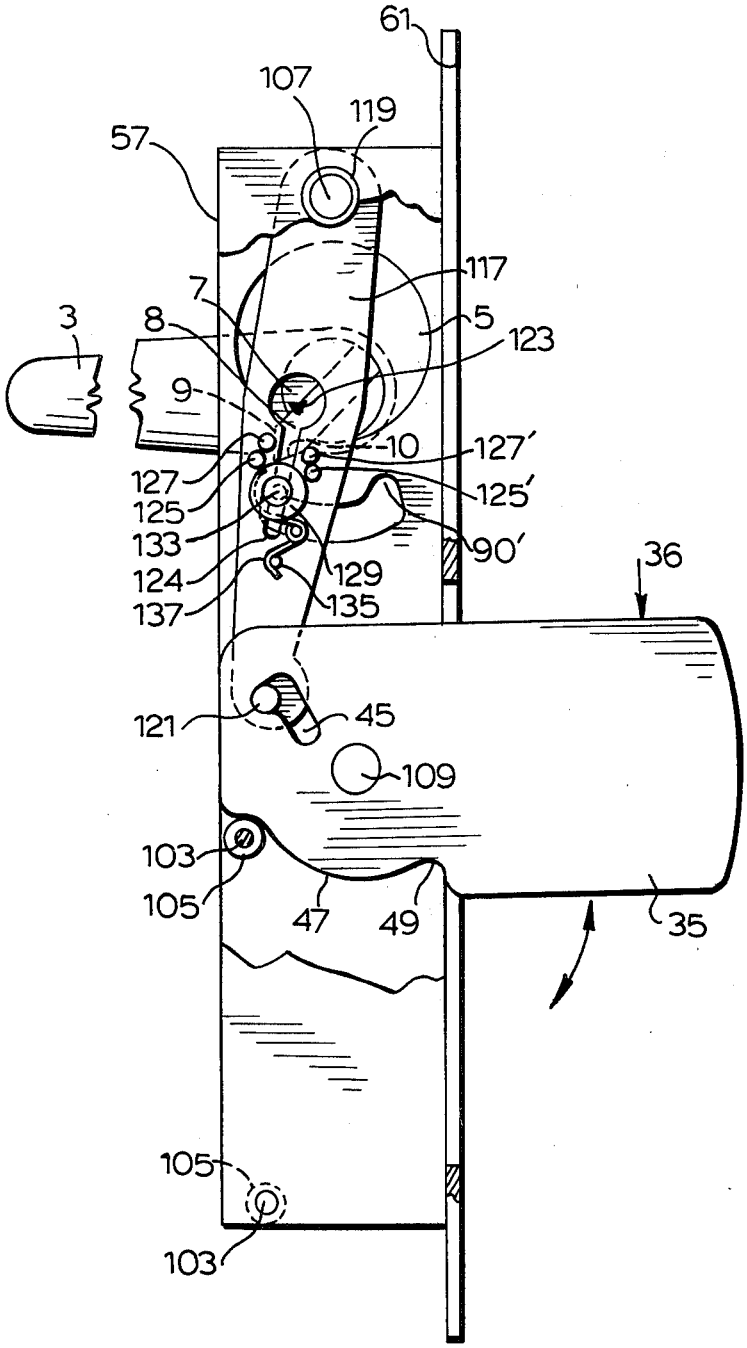
FIG. 2 is a partial sectional view of the safety lock of FIG. 1 taken in the direction of arrows 2—2 showing a pivotal bolt in a fully locking position.

Referring to FIG. 2, when pivotal bolt 35 is in a locking position, handle means 3 lies at essentially right angles to the lock housing. Lever 117 extends downwardly and to the rear of the lock housing with cylindrical extension 121 positioned in irregular aperture 45 as shown in FIG. 2. Roll pin 129 is located approximately mid-way through lower narrow end 124 of key shaped aperture 123 with camming surface 10 of operating arm 8 abutting roll pin 129 and camming surface 9 contacting trapping pin 127. This relationship is maintained because spring 137 forces roll pin 129 upwardly such that cylindrical end portion 133 is positioned in locking corner 90 of channel member 89 while trapping pin 127 prevents operating arm 8 from being forced upwardly due to the pressure exerted on it by the roll pin.

When roll pin 129 is in the above-described position, pivotal bolt 35 cannot be moved from a locking position to an unlocking position by exerting a force in the direction of arrow 36 on the bolt because of the locking relationship of cylindrical end portions 133, 133' and locking corners 90 and 96. In order to pivot bolt 35, one must either apply a downward force on handle 3 or pivot the bolt by means of a key. It should be noted that due to the positioning of handle 3 if pivotal bolt 35 were to jam, handle 3, which is an elongated bar, provides substantial leverage for a person attempting to rotate the jammed bolt. It is also readily apparent that the handle should be pushed downwardly to pivot the bolt from a locking to an unlocking position.

Figure 3:
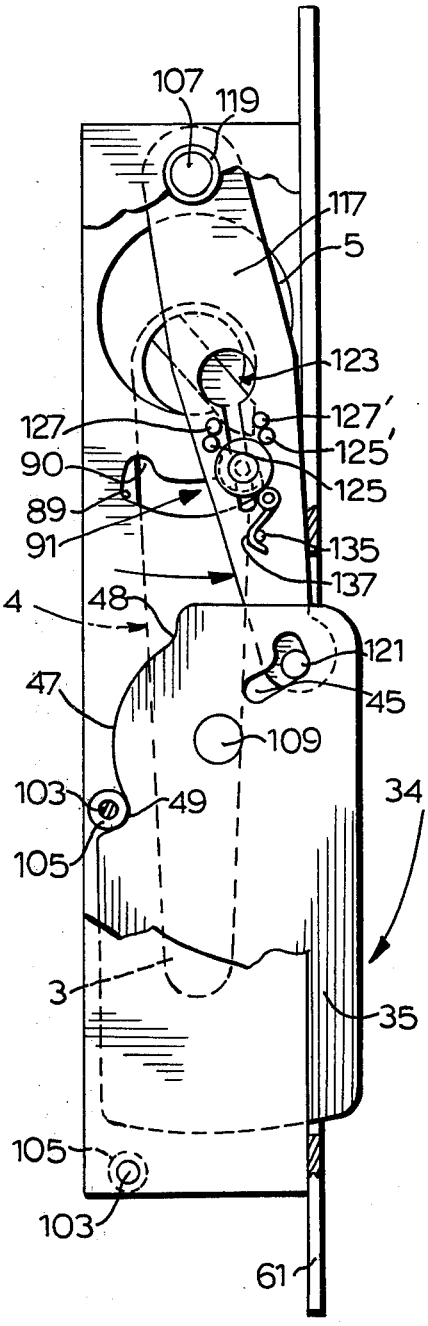
FIG. 3 is the partial sectional view of FIG. 2 showing a pivotal bolt in a fully unlocking position.

When the bolt is rotated to an unlocking position as shown in FIG. 3, handle 3 is forced in the direction of arrows 4 which pivots operating arm 8 provided on operating means 7 secured directly to the handle. Operating arm 8 forces the spring loaded roll pin downwardly out of the locking relationship with locking corners 90, 96 until end portion 133 of roll pin 129 contacts the bottom of slot 89. Upon further movement of the handle camming surface 10 of operating arm 8 cams over the upper surface of the roll pin to contact trapping pin 127' forcing lever 117 to pivot about upper shaft 107. The lower end of the lever moves towards face plate 61 in the direction of arrow 4. Roll pin 129 is confined in lower narrow end 124 of aperture 123 and due to the action of spring 137, the roll pin is forced to complete its movement through the channel member until it is positioned as shown in FIG. 3 with cylindrical end portions 133, 133' in locking corners 90' and 96'. It should again be noted that the roll pin and the operating arm are in an abutting relationship when the bolt is in a fully unlocking position due to the provision of springs 137 and trapping pins 127. However, because the operating arm has cammed over the surface of the roll pin, the contact is made between the roll pin and camming surface 9 rather than camming surface 10 so that the roll pin can be moved back to the position shown in FIG. 2 by turning handle 3 in the opposite direction.

When the roll pin is being forced in the direction of arrow 91, as above-described, and lever 117 pivots about upper shaft 109, pivotal bolt 35 is forced in the direction of arrow 34 to an unlocking position. As the lower end of lever 117 moves toward face plate 61, cylindrical extension 121 secured in irregular aperture 45, forces bolt 35 to pivot about lower shaft 109. During this rotation, undulating surface 47 overrides upper collar 105 until the collar is positioned in indentation 49. The bolt will not rotate beyond this point because lever 117 contacts front face 61 while bolt 35 contacts collar 105 at indentation 49.

As can be seen from the above description, operating arm 8 secured to handle 3 by operating means 7 is confined in its movement due to the provision of trapping pins 127, 127' one of which abuts camming surface 9 when pivotal bolt 35 is in a locking position and the other of which abuts camming surface 10 when the pivotal bolt is in an unlocking position. As a result of this confinement, handle 3 is restricted in its rotational movement. In this embodiment, the handle is restricted to a turning movement of approximately 90°. However as can be appreciated from the drawings, the amount of angular rotation can be varied by the positioning of trapping pins 127, 127'.

Figure 4:
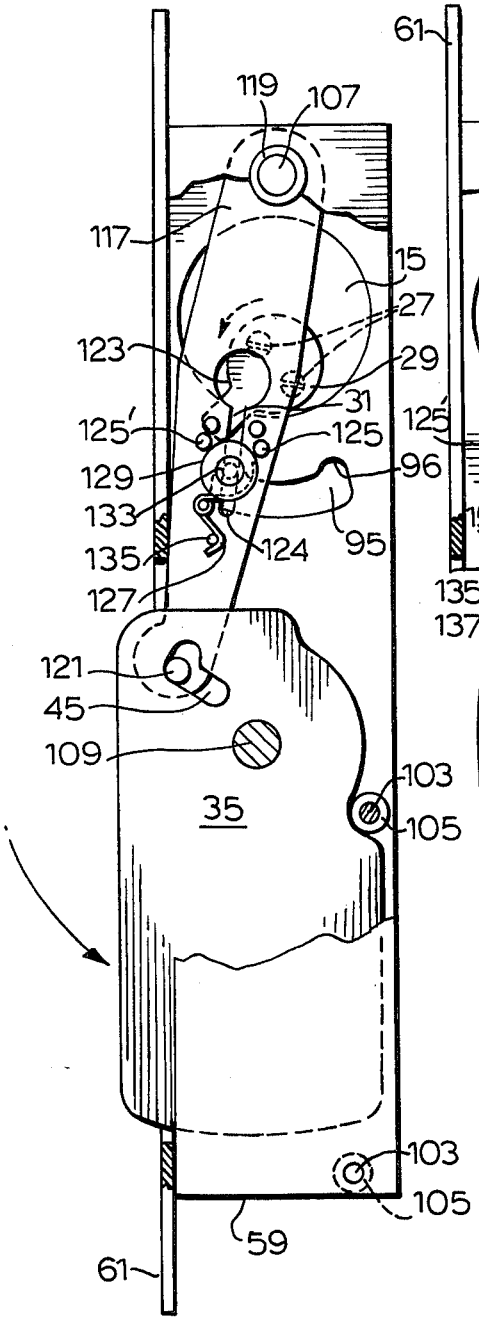
FIG. 4 is a partial sectional view of the safety lock of FIG. 1 taken in the direction of arrow 4—4 showing a pivotal bolt in a fully unlocking position.
Figure 5:
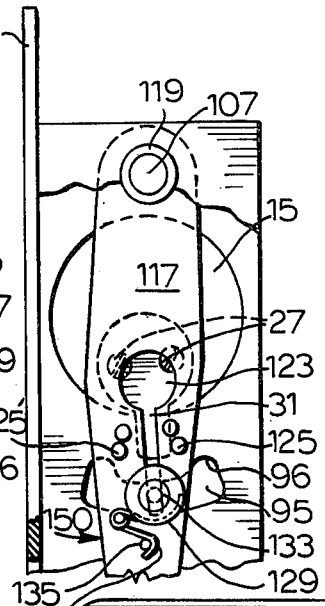
FIG. 5 is a partial sectional view of FIG. 4 showing a pivotal bolt in a semi-locking position.
Figure 6:
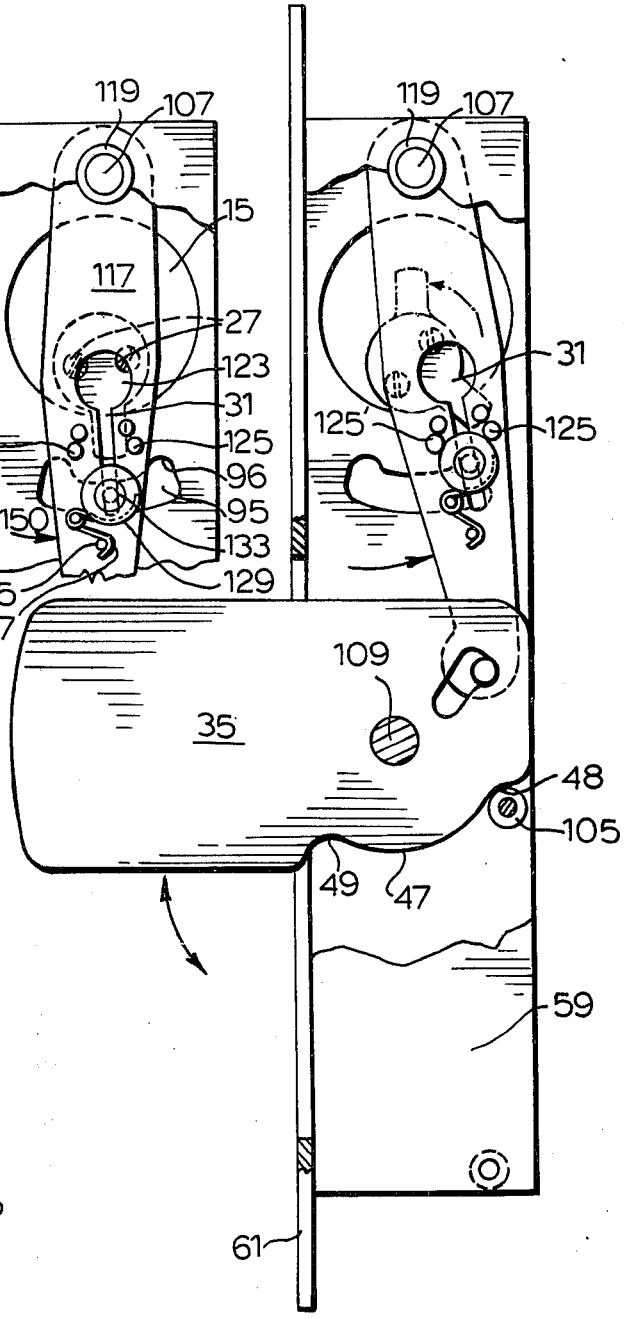
FIG. 6 is a partial sectional view of FIG. 4 showing a pivotal bolt in a fully locking position.

As earlier mentioned pivotal bolt 35 can also be moved from the unlocking position shown in FIGS. 3 and 4 to the locking position shown in FIGS. 2 and 6 by a key actuated means. Referring to FIGS. 4 through 6, a key (not shown) is inserted in key aperture 19 to effect movement of rotatable cylinder 21 which in turn rotates mounting means 29 provided with extension 31 secured to the rotatable cylinder. As cylinder 21 is rotated, extension 31 overrides peg 125' to abut rolling pin 129. Upon further rotation of the cylinder and mounting means, extension 31 forces the roll pin downwardly in lower narrow end 124 of key shaped aperture 123 thus compressing spring 137. Extension 31 overrides the upper surface of the roll pin and contacts the peg 125 as shown in FIG. 5. Once the contact is made between extension 31 and peg 125, lever 117 is forced to move in the direction arrow 150. Movement of the lever 117 is continued for the entire period that extension 31 is in contact with peg 125 until lever 117 is positioned as shown in FIG. 6. However when lever 117 is in that position extension 31 also overrides peg 125 to continue its rotation.

The movement of lever 117 by the key actuated means is substantially identical to that caused by the handle means. Lever 117 pivots about upper shaft 107 and cylindrical extension 121 of lever 117 moves in irregular aperture 45 from the position shown in FIG. 4 to the position shown in FIG. 6 forcing bolt 135 to pivot about lower shaft 109. Roll pin 129 is urged to a locking position in locking corners 90, 96 of slots 89 and 95 by means of springs 137, 137'. When the bolt is in a fully locking position, collar member 107 is fitted in indentation 48 of undulating surface 47 to prevent further movement of the bolt.

It should be noted as predominately shown in FIG. 6, that due to the lack of trapping pins 127, 127' on the side of the lever facing second side plate 59, extension 31 is not trapped by a trapping means and rotatable cylinder 21 can be rotated through an angle of at least 360°. Therefore, in contrast to the handle which can only be rotated through an angle determined by the positioning of the trapping pins which act as a trapping means to trap operating arm 8, the key actuated means can be rotated through a full 360° before fully pivoting the pivotal bolt.

As can be appreciated from earlier discussion as well as the drawings, the trapping pins can easily be mounted directly to the side plate of the housing adjacent the operating arm in positions such that an operating arm of the handle is trapped between them to restrict the rotation of the handle to an angle of less than 180°. If the pins, or any other means used to restrict movement of the handle, are mounted on the interior surface of the side plate an operating arm similar to that shown in the embodiment of FIGS. 1 through 5 can be used. If the trapping pins or other suitable trapping means are mounted on the exterior surface of the side plate, an additional arm can be provided on the rotatable shaft of the handle inside the lock cylinder. The additional arm would extend through a slot provided in the lock cylinder and would be trapped by the trapping means to restrict movement of the handle.

It would also be possible to provide trapping means on or in the lock cylinder to which the handle is rotatably secure. Again if the trapping means were provided on the portion of the cylinder inside the lock housing, the existing operating arm could be used to restrict movement of the handle. If the trapping means were provided inside the lock cylinder an additional arm would be provided inside the lock cylinder on the shaft of the handle.

In another embodiment of the invention, the lock cylinder is provided with an internal inwardly extending tab. The shaft of the handle is provided with a groove which extends partially around the shaft. The tab fits into the groove and contacts the ends of the groove when the handle is turned to restrict movement of the handle. The angle of rotation of the handle is determined by the length of the groove which acts as a trapping means.

As is understood from the above description, the handle and the key operate independently of one another. While the handle is restricted in its rotation the key rotates through an angle of at least 180° and preferably a full 360° to permit withdrawal of the key in both the locking and unlocking position.

Figure 7:
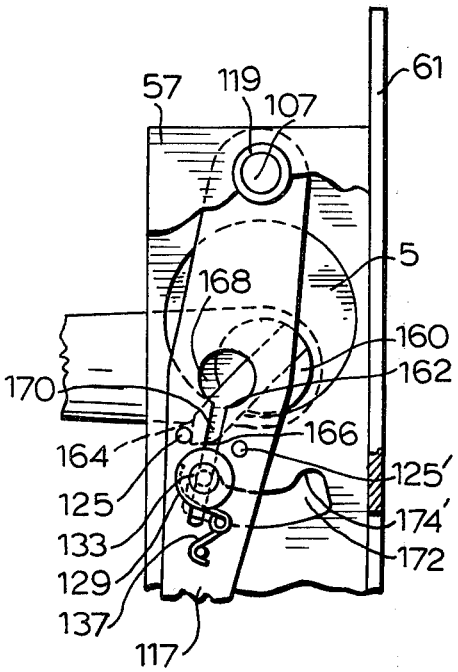
FIG. 7 is a partial sectional view of an alternative embodiment of the invention showing a safety lock with a pivotal bolt in a fully locking position.
Figure 8:
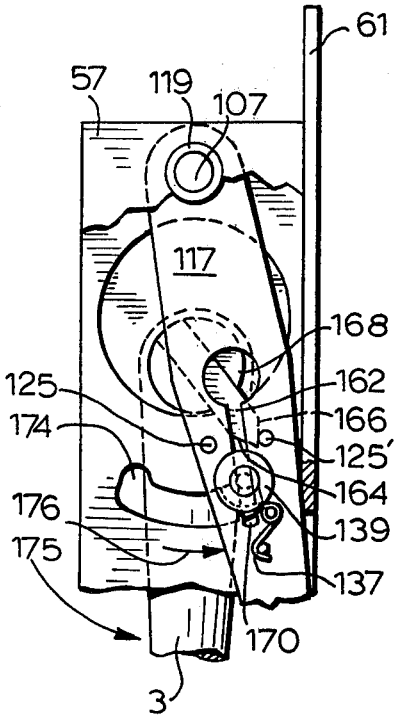
FIG. 8 is a partial sectional view of the safety lock of FIG. 7 with a pivotal bolt in a fully unlocking position.

A further alternative embodiment of the invention is shown in FIGS. 7 and 8. All parts of this alternative embodiment, except for those described below, are identical to those found in the embodiment of FIGS. 1 through 6. Lever 117 includes a key shaped aperture 168 having an extended narrow lower end 170. Operating means 160 having lengthened operating arm 162 provided with camming surfaces 164 and 166 is secured to handle 3. First side plate 57 is provided with a lowered slot 172 having locking corners 174, 174'.

When handle 3 is extending at essentially right angles to the lock housing, as shown in FIG. 7, the pivotal bolt which does not appear in the figure is in a locking position. Again in order to move the bolt from a locking to an unlocking position, the handle must be rotated downwardly in the direction of arrow 175 to a substantially vertical position shown in FIG. 8. The movement of the bolt by the handle means is very similar to that described in the embodiment shown in FIGS. 1 through 6.

When the pivotal bolt is in a fully locking position, camming surface 164 of lengthened operating arm 162 abuts peg 125 and camming surface 166 contacts roll pin 129. The roll pin which is urged into locking corner 174 by means of spring 137 is positioned about the mid-point of lengthened lower narrow end 170 of key shaped aperture 168.

As handle 3 is forced downwardly, operating arm 162 begins to move in the direction of arrow 175. This forces roll pin 129 downwardly in lengthened lower narrow end 170 out of the locking position. Camming surface 166 of the lengthened operating arm forces the roll pin to move to the left in lowered channel member 172 until it overrides the upper surface of the roll pin at which time camming surface 166 then contacts peg 125'. Once contact is made between lengthened operating arm 162 and peg 125', lever 117 is forced to pivot about upper shaft 107 toward face plate 61. As the lever begins to pivot in this manner, the pivotal bolt is moved from a locking to an unlocking position as earlier described.

When handle 3 is moved to a fully vertical position shown in FIG. 8, lengthened operating arm 166 which is still in contact with peg 125' forces lever 117 to move across the entire length of lower channel member 172 in the direction of arrow 176 until it abuts face plate 61. The pivotal bolt is now in a fully unlocking position.

It should again be noted in this embodiment that handle means 3 is restricted in its angular rotation due to the confinement of lengthened cam extension 162 between pegs 125 and 125'. The angular rotation of handle means 3, shown in FIGS. 7 and 8, is approximately 90°. However, this can be varied by the positioning of pegs 125 and 125'. This embodiment does not require the use of additional trapping pins because operating arm 162 has been lengthened and therefore will not override pegs 125 and 125'. However, to accommodate the increased length of the operating arm, channel member 172 must be lowered and key shaped aperture 168 must be provided with an extended lower narrow end. These features permit the lengthened cam extension to force roll pin 129 downwardly far enough to allow the camming surfaces of the operating arm to cam over the roll pin. The operating arm which is trapped between 125, 125' abuts peg 125' when forcing lever 117 to pivot the bolt from a locking position to an unlocking position, and abuts peg 125 when moving the lever to rotate the bolt from an unlocking position to a locking position.

The operating of the key actuated means for the embodiment shown in FIGS. 7 and 8 is similar to that described for the embodiment of FIGS. 1 through 6. However, as can be appreciated, in order to move the roll pin from a locking position extension 31 must be lengthened by the same amount as the operating arm is lengthened. Slot 95 is lowered accordingly so that pegs 125, 125' are appropriately spaced above the slot.

Figure 9:
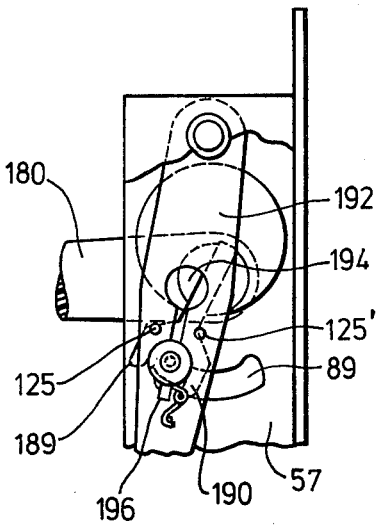
FIG. 9 is a partial sectional view of a further alternative embodiment of the invention, showing a safety lock with a pivotal bolt in a fully locking position.
Figure 10:
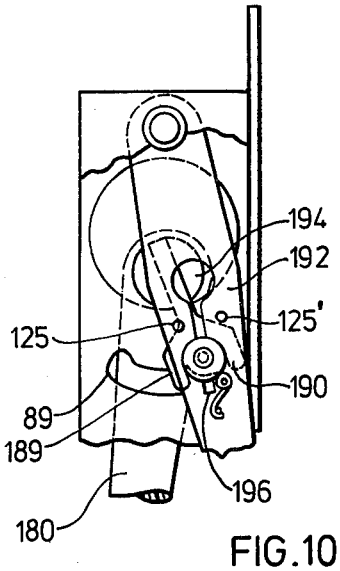
FIG. 10 is a partial sectional view of the safety lock of FIG. 9 with the pivotal bolt in a fully unlocking position.
Figure 11:
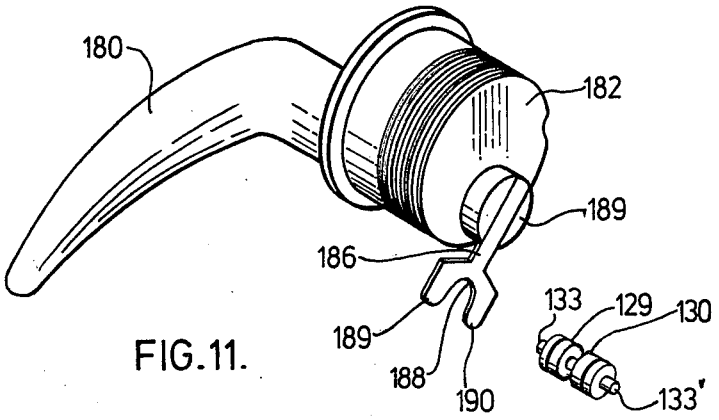
FIG. 11 is a perspective view looking down on the handle used to operate the safety lock shown in FIGS. 9 and 10.

FIGS. 9 through 11 show a further alternative preferred embodiment according to this invention. The principle of operation of this embodiment is very similar to the embodiments described above. The key actuated means according to this embodiment, is identical to that described with respect to FIGS. 1 through 6 and as such needs no further explanation. However, the handle means according to this embodiment has a somewhat different construction.

FIG. 11 shows handle 180, lock cylinder 182, operating means 184 provided with bifurcated member 186, and roll pin 129. When these components are secured in the lock as shown in FIGS. 9 and 10, the ends 133 and 133' of the roll pin are located in slots 89 and 95 of plates 57 and 59, respectively (plate 59 and its slot 95 do not appear in FIGS. 9 and 10). Roll pin 129 is trapped between arms 189 and 190 of bifurcated member 186, with the recessed portion 188 of the bifurcated member, mating with enlarged portion 130 of the roll pin.

In order to move the pivotal bolt from the locking position to the unlocking position, handle 180 is rotated downwardly and due to the engagement of arm 189 with roll pin 129, the roll pin is forced down and out of the locking position and across the slots in the plates, to an unlocking position. Arm 189 remains in contact with the roll pin, thereby precluding movement of the handle 180 through an angle greater than 90°. In fact, according to this embodiment, handle 180 is rotated through an angle of approximately 80°.

In order to move the bolt back to the unlocking position, handle 180 is simply re-rotated in the opposite direction and the roll pin is moved back to the locking position, due to the engagement between the roll pin and arm 180 of bifurcated member 186. Handle 180 will not go beyond the position shown in FIG. 9, because arm 190 remains in contact with the roll pin, which is trapped in the housing slots 89 and 95.

As can be seen in FIGS. 9 and 10, lever arm 192 again includes a key shaped aperture identified at 194, having an elongated slot 196. However, according to this embodiment, there is no need for the provision of pins 127 and 127'. Futhermore, pins 125 and 125' do not extend through the lever arm to the handle side of the mechanism as was the case of the embodiment described in FIGS. 1 through 6.

The construction shown in FIGS. 9 through 11 is one which is easily manufactured and has remarkable durability. To add to tht durability, bifurcated member 186 is preferably made from a tempered, hardened steel, although other constructions are also possible.

Although various preferred embodiments of the invention have been described herein in detail, it will be understood by those skilled in the art that variations may be made thereto without departing from the spirit of the invention or the scope of the appended claims.

The embodiments of the invention in which an exclusive property or priviledge is claimed are defined as follows:

1. A safety lock for use in a door, said safety lock comprising a lock housing, a pivotal bolt, bolt control means including a lever arm pivotally secured in said housing to pivot said bolt from a locking to an unlocking position, rotatable key actuated means and rotatable handle means for pivoting said lever to pivot said bolt approximately 90° from a locking to an unlocking position and means for restricting the rotation of said handle means to an angle of less than 180°, said key actuated means operating independently of said handle means and being adapted to rotate through an angle of at least 180°, said pivotal bolt extending from said housing when in said locking position, said key actuated means and said handle means being accessibly located on opposing sides of said housing.

2. A safety lock for use in a door, said safety lock comprising a lock housing, a pivotal bolt, bolt control means including a lever arm pivotally fixed in said housing and a roll pin slidingly secured in said housing for actuating said lever arm to pivot said bolt from a locking to an unlocking position and rotatable key actuated means and rotatable handle means for pivoting said lever to pivot said bolt approximately 90° from a locking to an unlocking position, said handle means being provided with an extension engaging said roll pin to pivot said lever, said extension being limited in its travel so that the rotation of said handle means is restricted to an angle of less than 180°, said key actuated means operating independently of said handle means and being adapted to rotate through an angle of at least 180°, said pivotal bolt extending from said housing when in said locking position, said key actuated means and said handle means being accessibly located on opposing sides of said housing.

3. A safety lock as claimed in claim 2 wherein the rotation of said handle means is restricted to an angle of approximately 90° and said key actuated means is adapted to rotate through an angle of at least 360°.

4. A safety lock as claimed in claim 3 wherein said extension is a bifurcated arm fitted over said roll pin, the bifurcations on said arm precluding movement of same past said roll pin thereby restricting the rotation of said handle means to an angle of approximately 90°.

5. A safety lock as claimed in claim 3 wherein said extension is an operating arm having opposing bevelled faces at its free end for sliding said roll pin, said lock being provided with means for trapping said operating arm, said means for trapping said operating arm being positioned so as to restrict the rotation of said handle means to an angle of approximately 90°.

6. A safety lock as claimed in claim 5 wherein said means for trapping said operating arm comprises two spaced pins provided on said leverl.

7. A safety lock as claimed in claim 3 wherein said handle means comprises an elongated bar for providing substantial leverage, said elongated bar extending in a substantially horizontal plane from said housing when said pivotal bolt is in its fully locking position, the arrangement being such that said bar is rotated downwardly to pivot said bolt to the unlocking position.

* * * * *